United States Patent [19]

Nestor et al.

[11] Patent Number: 4,521,065

[45] Date of Patent: Jun. 4, 1985

[54] SOCKET CONNECTOR FOR PARALLEL CIRCUIT BOARDS

[75] Inventors: Charles R. Nestor, Niles; Robert G. Plyler, Vienna; William E. Cross, Brookfield, all of Ohio

[73] Assignee: General Motors Corporation, Detroit, Mich.

[21] Appl. No.: 536,303

[22] Filed: Sep. 27, 1983

[51] Int. Cl.[3] ..... H01R 9/09

[52] U.S. Cl. ..... 339/75 MP; 339/17 LM; 339/176 MP

[58] Field of Search ..... 339/17 M, 17 LM, 75 MP, 339/176 MP

[56] References Cited

U.S. PATENT DOCUMENTS

| | | | |
|---|---|---|---|
| 2,904,768 | 9/1959 | Rasmussen | 339/17 |
| 3,048,811 | 8/1962 | Lock | 339/176 MP |
| 3,132,913 | 5/1964 | Pohl | 339/97 |
| 3,246,280 | 4/1966 | Scagnelli | 339/17 |
| 3,340,440 | 9/1967 | Minter | 317/101 |
| 3,626,361 | 12/1971 | Bonhomme | 339/176 MP |
| 3,778,753 | 12/1973 | Occhipinti et al. | 339/156 R |
| 3,858,961 | 1/1975 | Goodman et al. | 339/176 MP |
| 3,903,458 | 9/1975 | Arnoux | 339/128 |
| 3,940,849 | 3/1976 | Minter | 29/628 |
| 4,028,794 | 6/1977 | Richie et al. | 29/629 |
| 4,029,374 | 6/1977 | Nestor et al. | 339/17 F |
| 4,061,405 | 12/1977 | Minter | 339/17 M |
| 4,220,382 | 9/1980 | Ritchie et al. | 339/17 LM |
| 4,250,536 | 2/1981 | Barringer et al. | 361/413 |

FOREIGN PATENT DOCUMENTS

| | | | |
|---|---|---|---|
| 657372 | 2/1963 | Canada . | |
| 1033247 | 6/1966 | United Kingdom | 339/75 MP |

*Primary Examiner*—John McQuade
*Attorney, Agent, or Firm*—F. J. Fodale

[57] ABSTRACT

A socket connector for parallel circuit boards comprises a dielectric connector body and a plurality of sinuous contact strips which are inserted into cavities in the connector body through top openings and individually retained in the cavities. The contact strips have end tabs disposed in shallow slots in the connector body side walls to stabilize the contact strips and facilitate removal.

12 Claims, 8 Drawing Figures

SOCKET CONNECTOR FOR PARALLEL CIRCUIT BOARDS

This invention relates generally to an electric socket connector and, more particularly, to an electric socket connector for connecting the end portions of a plurality of parallel circuit boards, or the like.

U.S. Pat. No. 3,903,458 issued to Daniel Arnoux on Sept. 2, 1975 discloses a modular illuminated indicator panel mounted housing having an electric socket connector of the above-noted type. More specifically, the Arnoux patent discloses a casing 1 which houses two circuit boards 58,59 which are plugged into a connection unit 35 at one end of the casing. The connection unit 35, FIGS. 1, 2 and 3, comprises a dielectric connector body 36 which contains a plurality of stamped sheet metal terminal connectors 46,48 which are retained by a closure plate 52. These terminal connectors have two pairs of retaining arms or clips 51 which engage the respective end portions of the circuit boards 58,59 when the end portions are plugged into the connector body 36. The Arnoux connection unit 35 has several drawbacks, particularly with regard to the closure plate 52 which makes replacement of individual terminal connectors difficult and substantially decreases the isolation of the clips 51 from each other. Replacement would be even more difficult in the absence of the protruding lugs 47,49.

U.S. Pat. No. 2,904,768 issued to George Rasmussen on Sept. 15, 1959 also discloses a socket connector for connecting the end portions of a plurality of parallel circuit boards. The Rasmussen socket connector has contact members 50 bent from flat sheet metal strips to provide resilient U-shaped contact portions 51. The isolation of the contact portions 51 from those of an adjacent strip is good. However, the housing for the contact members 50 comprises a base plate member 20 and a plurality of contact supporting structures 21, 22 affixed to the base plate member 20. Assembly of the unit is difficult and the contact members 50 cannot be removed without disassemblying the multipiece housing.

U.S. Pat. No. 3,048,811 issued to Tom Lock on Aug. 7, 1962 discloses a socket connector for circuit boards which comprises a holder 1 and a plurality of contacts 8 which are formed from a wire having a circular cross section. The contacts 8 are retained in recesses of the holder 1 by shank portions 9 of the contacts 8 which protrude through holes in the bottom of holder 1. Here the problem is that the socket connector can receive only one circuit board and the contacts 8 are not easily replaceable in the absence of the protruding shanks 9.

The object of this invention is to provide an improved electric socket connector for connecting the end portions of a plurality of parallel circuit boards.

One feature of the invention is the use of contact strips which are inserted into cavities of a one piece connector body through top openings of the cavities and individually retained in the cavities so that individual contact strips can be replaced easily without releasing the others.

Another feature of the invention is that the contact strips are easily removed in the absence of lugs or shanks protruding through the bottom of the connector body.

Another feature of the invention is that the side walls of the connector body have shallow slots for stabilizing the ends of the contact strips and making the ends accessible to facilitate removal of individual contact strips from the connector body.

Another feature of the invention is that the contact strips are simple in construction and may be formed from a length of wire of circular cross section.

Yet another feature of the invention is that the partition walls defining the cavities in the connector body are full height between the circuit board slots which improves the isolation of the contact strips from each other.

Still yet another feature of the invention is that the connector body may have lugs for locking the circuit boards in place which eliminates the need for frictional retention of the circuit boards and, consequently, the high insertion forces associated therewith.

Other objects and features of the invention will become apparent to those skilled in the art as the disclosure is made in the following detailed description of a preferred embodiment of the invention as illustrated in the accompanying sheets of drawing in which.

Figure 1:
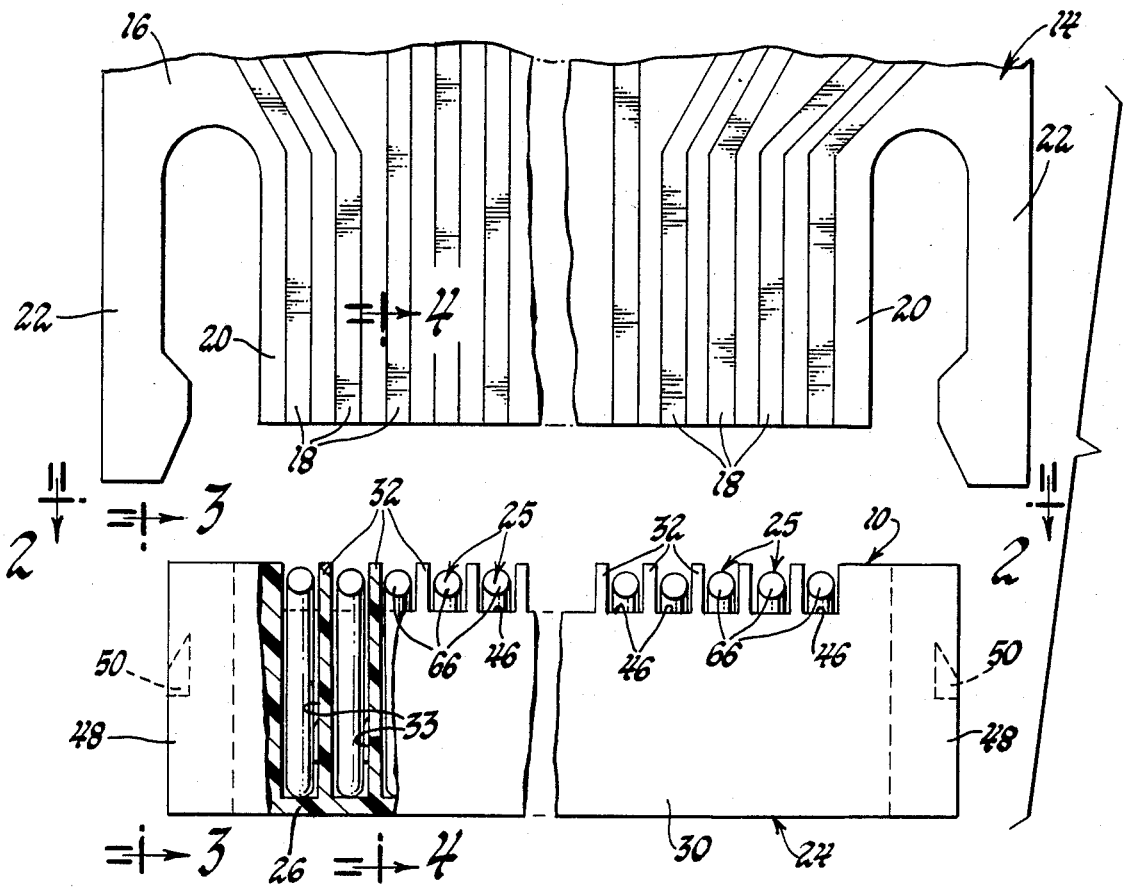
FIG. 1 is a partially sectioned side view of an electrical socket connector in accordance with this invention and a circuit board positioned for insertion into the top of the electrical socket connector.

Referring now to the drawing, FIG. 1 shows an electrical socket connector 10 for connecting the end portions of a pair of circuit boards 12,14 which are disposed parallel to each other. Each of the circuit boards 12,14 comprise a dielectric hard board 16 made of a phenolic resin, for example, and a plurality of thin conductive strips 18 of copper or the like. The conductive strips 18 may be provided on one or both surfaces of the hard board 16 by any of several well known techniques. The conductive strips 18 are arranged in any desired pattern on the circuit boards 16 and any number of electrical or electronic devices (not shown) may be secured to the circuit board 16 and electrically connected to the conductive strips 18 to form a desired electrical circuit or circuits. The circuit board 12 or 14 customarily has an edge or end portion 20 which serves as a plug-in connector and where the conductive strips 18 are arranged in a parallel fashion or close centerlines. In this instance, the circuit board 12 or 14 also has flat, stiffly flexible latch arms 22 spaced to either side of the end portion 20.

Figure 2:
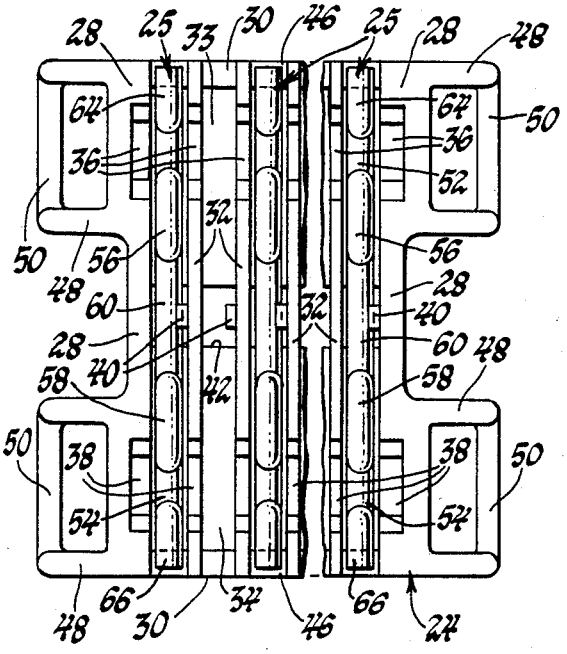
FIG. 2 is a top view of the electrical socket connector shown in FIG. 1 taken substantially along the line 2—2 of FIG. 1 looking in the direction of the arrows.
Figure 3:
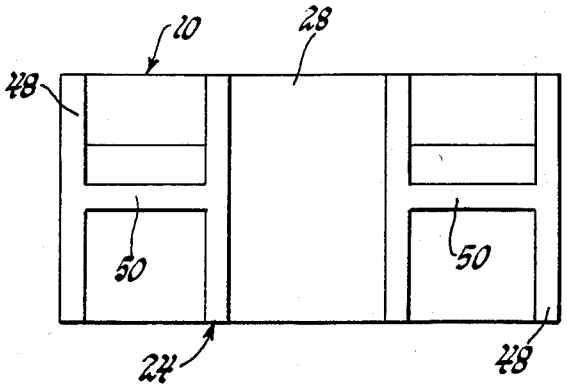
FIG. 3 is an end view of the electrical socket connector shown in FIG. 1 taken substantially along the line 3—3 of FIG. 1 looking in the direction of the arrows.
Figure 4:
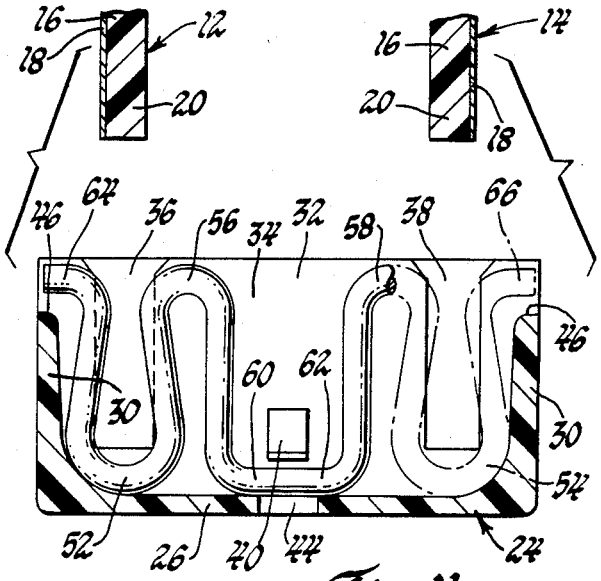
FIG. 4 is a section taken substantially along the line 4—4 of FIG. 1 looking in the direction of the arrows.
Figure 5:
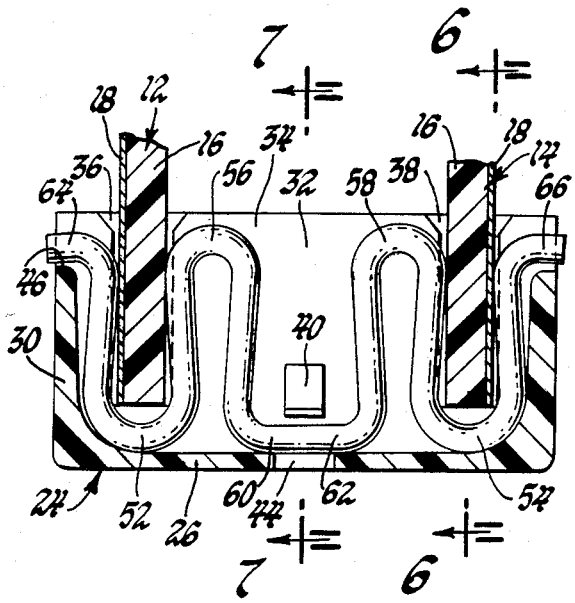
FIG. 5 is a section view similar to FIG. 4 showing the end portions of the parallel circuit boards plugged into the socket connector.
Figure 7:
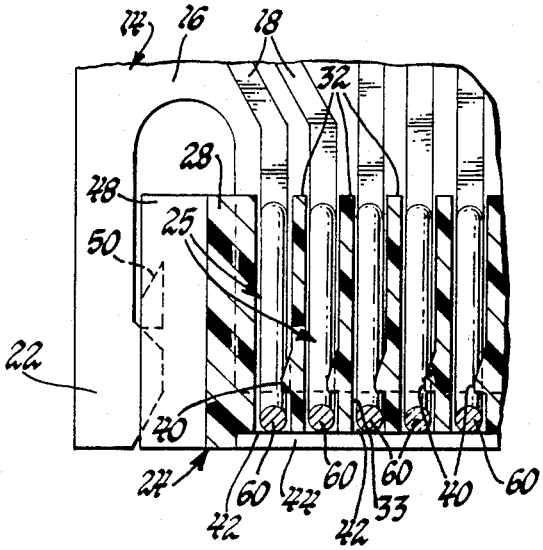
FIG. 7 is a section taken substantially along the line 7—7 of FIG. 5 looking in the direction of the arrows.

The electrical socket connector 10 for the circuit boards 12 and 14 comprises a dielectric one piece connector body 24 of box-like construction and a plurality of sinuous contact strips 25. The connector body 24 has a bottom wall 26, two end walls 28 and two side walls 30. The connector body 24 also includes a plurality of spaced partition walls 32 which are parallel to the end walls 28 and which define a row of cavities 33 in cooperation with the end walls 28 and the side walls 30. The cavities 33 have openings 34 at the top of the connector body which extend for the full width and length of the respective cavities as best shown by the empty cavity in FIG. 2. As best shown in FIGS. 2, 4 and 5, the end walls 28 and the partition walls 32 are slotted to provide a first and second series of aligned slots 36 and 38 which extend through the partition walls 32 and partially into the end walls 28. The series of slots 36,38 are open at the top of the connector body and extend part way down into the partition walls 32 and the end walls 28 for receiving the plug-in end portions 20 of the respective circuit boards 12 and 14, respectively. The median portion of each partition wall 32 between the slots 36 and 38 is full height and has a lock nib 40 near the bottom wall 26 as shown in FIGS. 4 and 5. The lock nibs 40 project into the respective cavities 33 to individually retain the respective contact strips 25 therein as shown in FIG. 7. One of the end walls 28 also has a lock nib 40 as shown in FIG. 2.

The bottom wall 26 has a series of small rectangular openings 42 communicating with an external medial groove 44 in the bottom wall 26. The small rectangular openings 44 provide access to the respective cavities 33 to facilitate molding of the lock nibs 40.

Figure 6:
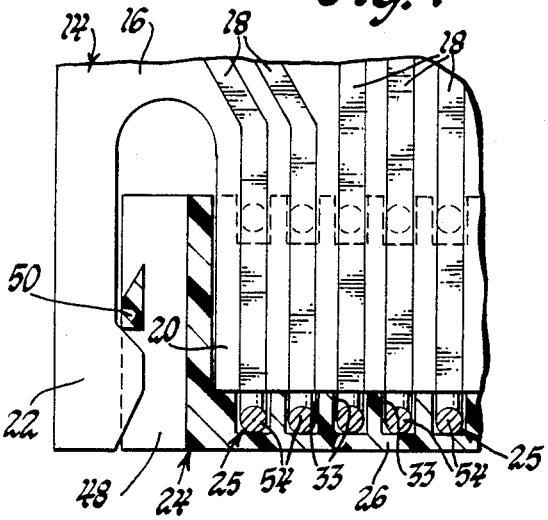
FIG. 6 is a section taken substantially along the line 6—6 of FIG. 5 looking in the direction of the arrows.

Each side wall 30 has a series of shallow slots 46 extending through its upper end portion. The shallow slots 46 of the respective side walls 30 are aligned with and open into the opposite lateral ends of the cavities 33 as shown in FIGS. 1, 2, 4, 5 and 6. Each end wall 28 also has a pair of lugs 48 which include a lock bar 50. The lock bars 50 cooperate with the lock arms 22 on the circuit boards 12,14 to lock the circuit boards 12,14 in place as shown in FIGS. 6 and 7.

Figure 8:
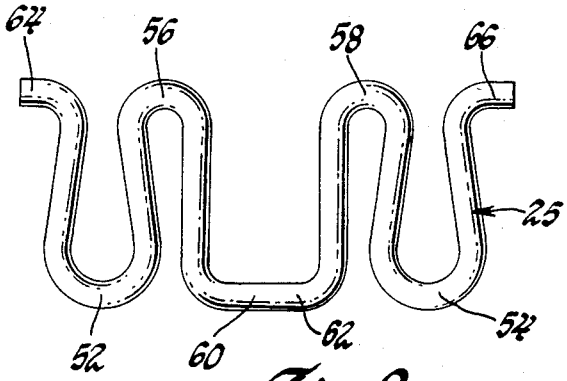
FIG. 8 is a front view of one of the contact strips shown in FIGS. 1–7.

The electrical socket connector 10 also includes a plurality of sinuous contact strips 25 which may be made conveniently from a length of wire of circular cross section which is bent to the form show in FIG. 8. More particularly, the sinuous contact strip 25 comprises resilient U-shaped clip portions 52,54 adjacent the respective ends of the strip. Each resilient clip portion 52,54 has a round or curved bottom and straight legs which converge toward each other at the open end of the clip portion where the legs are curved outwardly. The curved inboard ends 56,58 of the resilient clip portions 52,54 are connected by an intermediate U-shaped locking portion 60 having parallel legs and a straight bottom which serves as a lock bar 62. The parallel legs of the U-shaped locking portion 60 are spaced from the adjacent legs of the clip portions 52,54 to increase the flexibility of the contact strip 25 since the parallel legs also deflect when the circuit boards 12,14 are received in the clip portions 52,54 as shown in FIG. 5. The curved outboard or free ends of the clip portions 52,54 are approximately right angle bends which continue to form tabs 64 and 66 at the respective ends of the contact strip 25.

A contact strip 25 is inserted in each of the cavities 33 through the respective top openings 34 and each contact strip 25 is individually retained in its respective cavity by the lock nib 40 in cooperation with the lock bar 62 as shown in FIGS. 2, 4, 5 and 7. In the retained position, the resilient U-shaped clip portions 52 and 54 are aligned with the series of slots 36 and 38 respectively and the tabs 64 and 66 are disposed in the series shallow slots 46 extending through the two side walls 30 as shown in FIG. 4. Each contact strip 25 may be removed from the connector body 10 easily without disturbing the other contact strips. This may be done simply by lifting either the tab 64 or 66 out of its slot 46. The tab at the opposite end of the contact strip then fulcrums against the bottom of its slot 46 and the contact strip acts as a lever forcing the lock bar 62 past the lock nib 40. Thus, each contact strip may be removed easily without distrubing the others and even though the contact strip does not protrude through the bottom wall 26.

When all of the contact strips 25 are disposed in the connector body 10 as shown in FIG. 4, the ends of the parallel circuit boards 12,14 are connected mechanically and electrically simply by plugging their respective end portions 20 into the series of slots 36 and 38 as shown in FIG. 5. The slots 36 and 38 guide the end portions 18 into the connector body 24 and into the clip portions 52 and 54 of the contact strips 25 which establish electrical connections between the circuit boards. The circuit boards 12,14 are held in place by the resilient arms 20 engaging the lock bars 50 as shown in FIGS. 6 and 7.

We wish it to be understood that we do not desire to be limited to the exact details of construction shown and described, for obvious modifications will occur to a person skilled in the art.

The embodiments of the invention in which an exclusive property or privilege is claimed are defined as follows:

1. An electrical socket connector for connecting the ends of a plurality of parallel circuit boards, comprising a dielectric connector body of box-like construction having side walls, end walls and a plurality of spaced partition walls which define a row of cavities which have openings at the top of the connector body, a first and a second series of aligned slots in the partition walls which are open at the top of the connector body for receiving respective ends of first and second circuit boards in the row of cavities, a lock nib extending into each cavity from an end wall or a partition wall defining the cavity, and a plurality of sinuous contact strips disposed in the respective cavities, each said contact strip having resilient U-shaped clip portions alinged with the first and second series of aligned slots, respectively, and an intermediate U-shaped locking portion, each said contact strip being insertable into a respective cavity through the opening at the top of the connector body and individually retained therein by cooperation of the locking portion and the lock nib.

2. The electrical socket connector as defined in claim 1 wherein the partition walls are full height between the first and second series of aligned slots.

3. The electrical socket connector as defined in claim 1 wherein each contact strip is a bent wire of circular cross section.

4. The electrical socket connector as defined in claim 1 wherein the dielectric body has a pair of lock bars on each end wall for locking the circuit boards in place.

5. An electrical socket connector for connecting the ends of a plurality of parallel circuit boards, comprising a dielectric connector body of box-like construction having side walls, end walls and a plurality of spaced partition walls which define a row of cavities which have openings at the top of the connector body, a first and a second series of aligned slots in the partition walls which are open at the top of the connector body for receiving respective ends of first and second circuit boards in the row of cavities, a row of shallow slots extending through the top portion of one side wall and communicating with the respective cavities, a lock nib extending into each cavity from an end wall or a partition wall defining the cavity, and a plurality of sinuous contact strips disposed in the respective cavities, each said contact strip having resilient U-shaped clip portions aligned with the first and second series of aligned slots, respectively, and an intermediate U-shaped locking portion, each said contact strip being insertable into a respective cavity through the opening at the top of the connector body and individually retained therein by cooperation of the locking portion with the lock nib, and each said contact strip having an end tab which is disposed in a shallow slot extending through the top portion of the one side wall for stabilizing the contact strip in the cavity and assisting in its removal therefrom.

6. The electrical socket connector as defined in claim 5 wherein the partition walls are full height between the first and second series of aligned slots.

7. The electrical socket connector as defined in claim 5 wherein each contact strip is a bent wire of circular cross section.

8. The electrical socket connector as defined in claim 5 wherein the dielectric body has a pair of lock bars on each end wall for locking the circuit boards in place.

9. An electrical socket connector for connecting the ends of a plurality of parallel circuit boards, comprising a dielectric connector body of box-like construction having side walls, end walls and a plurality of spaced partition walls which define a row of cavities which have openings at the top of the connector body, a first and a second series of aligned slots in the partition walls which are open at the top of the connector body for receiving respective ends of first and second circuit boards in the row of cavities, a row of shallow slots extending through the top portion of each side wall and communicating with the opposite lateral ends of the respective cavities, a lock nib extending into each cavity from an end wall or a partition wall defining the cavity, and a plurality of sinuous contact strips disposed in the respective terminal cavities, each said contact strip having resilient U-shaped clip portions aligned with the first and second slots, respectively, and an intermediate U-shaped locking portion connected to the inboard ends of the U-shaped clip portions, each said contact strip being insertable into a respective cavity through the opening at the top of the connector body and individually retained therein by cooperation of the locking portion with the lock nib, and each said contact strip having end tabs which are at the outboard free end of the respective resilient U-shaped clip portions and which are disposed in the shallow slots extending through the respective side walls.

10. The electrical socket connector as defined in claim 9 wherein the partition walls are full height between the first and second series of aligned slots.

11. The electrical socket connector as defined in claim 9 wherein each contact strip is a bent wire of circular cross section.

12. The electrical socket connector as defined in claim 9 wherein the dielectric body has a pair of lock bars on each end wall for locking the circuit boards in place.

* * * * *